US007191576B2

(12) United States Patent
Talou

(10) Patent No.: US 7,191,576 B2
(45) Date of Patent: Mar. 20, 2007

(54) DEVICE FOR APPLYING A PREPARED HANDLE TO A PACK

(75) Inventor: Pierre Talou, Cremieu (FR)

(73) Assignee: Cefma, Genas (FR)

( * ) Notice: Subject to any disclaimer, the term of this patent is extended or adjusted under 35 U.S.C. 154(b) by 0 days.

(21) Appl. No.: 11/079,176

(22) Filed: Mar. 15, 2005

(65) Prior Publication Data

US 2005/0274087 A1 Dec. 15, 2005

(30) Foreign Application Priority Data

Mar. 15, 2004 (FR) ..... 04 02648

(51) Int. Cl.
*B65B 61/14* (2006.01)
*B31B 1/86* (2006.01)

(52) U.S. Cl. ..... 53/413; 53/64; 53/134.1; 493/88; 493/226; 493/909; 493/926

(58) Field of Classification Search ..... 53/413, 53/64, 67, 69, 74, 134.1; 493/88, 226, 909, 493/926; *B65B 61/14*
See application file for complete search history.

(56) References Cited

U.S. PATENT DOCUMENTS 3,834,970 A * 9/1974 Mitsuoka et al. ..... 156/489
3,861,983 A * 1/1975 Harrell ..... 156/361
4,415,399 A * 11/1983 Geisinger ..... 156/475
5,052,165 A * 10/1991 Gunther ..... 53/413
5,230,205 A * 7/1993 Hautemont ..... 53/485
5,458,726 A * 10/1995 Castoldi ..... 156/355
6,234,230 B1 * 5/2001 Petitjean ..... 156/522

FOREIGN PATENT DOCUMENTS

DE 10211996 A1 * 11/2003
EP 310831 A1 * 4/1989
EP 560699 A1 * 9/1993
EP 1088761 A1 * 4/2001
FR 2787416 A * 6/2000

* cited by examiner

*Primary Examiner*—Stephen F. Gerrity
(74) *Attorney, Agent, or Firm*—Oliff & Berridge, PLC

(57) ABSTRACT

A device for making it possible to apply to a pack, moved along a conveyor, a handle (n) of nominal length L situated at the end of a tape. The tape includes a succession of handles (n+i), each handle comprising two adhesive ends and a central part. The device includes a feeder to move the tape as far as a rotary application arm having a length which is equal to the nominal length L. This arm is able to deposit one adhesive end of the handle n on one face of the pack and then the second end of the handle n on a second face of the pack. The device further includes an optical cell for detecting an offset in the position of a handle n+i, an actuator for elongating the length of the rotary arm beyond the nominal length L, making it possible during a rotation of this arm to draw a portion of tape having a length greater than the nominal length, and a control unit.

15 Claims, 3 Drawing Sheets

DEVICE FOR APPLYING A PREPARED HANDLE TO A PACK

This non-provisional application claims the benefit of French Application No. 04 02648, filed on Mar. 15, 2004, the entire disclosure of which is incorporated herein by reference.

BACKGROUND

The present invention relates to a device and to a method of applying a carrying handle to a pack.

Many consumer products come in the form of packs. A classic example is a multipack containing a number of bottles of water packed together under a plastic film. The term pack is therefore understood as referring to any product or set of products having a substantially parallelepipedal form.

For the purpose of transporting these packs, it is known practice to affix a handle thereto. This handle consists of a tape whose two ends are provided with an adhesive. The handle is therefore applied to the pack such that the two ends coated with adhesive stick onto the vertical walls of the pack, while the central part of the handle forms a grip by means of which the pack can be taken hold of and transported.

A very advantageous device for applying such a handle is known from document EP 560 699 or from document FR 2 787 416. This device uses a rotary arm which deposits and sections an adhesive tape supplied continuously to a pack. By virtue of its rotary arm, this device makes a very high application rate possible. At the moment when a handle is being applied, a label, that is to say a rectangular cardboard element (sometimes referred to as a strip), which may be used as an advertising medium, is generally attached to the tape.

However, this way of producing and applying a handle, that is to say using, on the one hand, an adhesive tape (transparent or translucent monochrome tape) and, on the other hand, a label attached at the moment of application, is now being increasingly replaced by a type of handle known as "prepared handle".

The term prepared handle is intended to mean a handle which incorporates a label. In order to limit the number of feeders (tape feeders and label feeders), the labels are thus placed uniformly on the adhesive tape with a defined pitch, the tape being in the form of a reel.

With the use of a device such as that described in documents EP 560 699 or FR 2 787 416, the rotary arm determines the length of a handle, the length of the handle being dependent on the size of the pack.

Each pack therefore determines a handle length, which in turn determines a length of the rotary arm performing the ad hoc application and sectioning of the handle.

In the case of a so-called prepared handle, the reel of tape comprises a succession of handles arranged one behind the other.

Thus, it is imperative that the tape be sectioned to the exact nominal length of the handle, failing which the label is no longer centered with respect to the pack to which the handle is applied. Since the handles are arranged in series, an error in the positioning of a handle has repercussions on the application of the subsequent handles and may cumulate with other errors due to the elongation of subsequent handles.

It should be noted that this problem is specific to prepared handles; in the case of an attached label, the latter is supplied at the moment of application and cutting of the adhesive tape, that is to say independently of the application and cutting of the tape.

In the case of prepared handles, that is to say those incorporating labels distributed at predetermined fixed intervals and applied by a device with a rotary arm as shown in EP 560 699 or FR 2 787 416, it is found that a drift inevitably occurs in the application of the handles.

This drift is due particularly to the fact that, during the application, the rotary arm exerts a tension on the tape in order to apply it to the pack. To give a clearer idea, this tension can be set at around 7 daN. This tension varies as a function of each reel, particularly as a function of the degree of gluing or of the ambient temperature acting on the viscosity of the adhesive and as a function of the position at which the tape is drawn from the reel.

The tension exerted on the tape causes an elongation of the tape. The coefficient of elongation itself varies from one reel to another and, in practice, the elongation of the tape is between 0.5% and 1.5%.

One may take the example of an adhesive tape incorporating handles having a nominal length of 500 mm. The term nominal length is to be taken in its usual sense, that is to say the theoretical length announced by the tape manufacturer. As is customary, the manufacturer guarantees the nominal length with a tolerance range which is of the order of ±1 mm.

It will thus be understood that, with respect to the nominal length of 500 mm, the actual length of the applied handle may vary between two extreme values, namely $499\times1.005=501.5$ mm and $501\times1.015=508.51$ mm. The very significant consequence to be underlined is that the length of the tape varies in a non-reproducible manner, thereby making it impossible to determine, a priori, the elongation of the tape so that it can be incorporated into the length of the rotary arm.

These random variations in the length of the tape prevent, in practice, the application of prepared handles using a device with a rotary arm which, otherwise, would have a considerable benefit in terms of application rate.

SUMMARY

The object of the invention is therefore to propose an application device using a rotary arm making it possible to apply prepared handles.

In a manner known per se, this device making it possible to apply to a pack, moved along a conveyor, a handle n of nominal length L situated at the end of a tape comprises a succession of handles n+i, each comprising two adhesive ends and a central part. This device comprises means for feeding the tape as far as a rotary application arm having a length which is equal to the nominal length L; the rotary arm is able to deposit one adhesive end of the handle n on one face of the pack and then the second end of the handle n on a second face of the pack during a 180° rotation of the arm which is synchronous with the advancing movement of the pack on the conveyor.

According to the invention, the device comprises:

means for detecting an offset in the position of a handle n+i, which is awaiting application and is situated upstream of a handle n, with respect to the theoretical position of the handle n+i corresponding to a multiple of the nominal length, this offset being due to an elongation of the handle n beyond the nominal length, and means for elongating the length of the rotary arm beyond the nominal length, making it possible during a rotation of this arm to draw a portion of tape having a length greater than the nominal length, a control unit which is connected, on the one hand, to the detection means and can receive a signal therefrom if an offset in the position of a handle n+i with respect to the theoretical position of the handle n+i is detected and which is connected, on the other hand, to the elongation means so as to control the elongation thereof if an offset is detected.

The invention is based on providing dynamic compensation, that is to say that, following the identification of an offset in a handle upstream of the handle awaiting application, a correction is made to the length of the arm. The consequence of this action on the length of the arm during the operation of the device is the fact that the arm, during its rotation, will draw a length of tape greater than the nominal length and, thus, reestablishes correct positioning of the tape with respect to the arm. The identification of an offset therefore results in immediate correction.

According to one advantageous possibility, the device comprises a means for the optical detection of an offset in the position of a handle n+i.

Preferably, an optical detection cell is placed along the path over which the tape unwinds at a distance from the rotary arm which is equal to a multiple of the nominal length of a handle less the length of one adhesive end, with the result that the cell which is placed along the route taken by the tape detects the presence of the central part, which is generally opaque, as opposed to the adhesive end, which is translucent. The cell is positioned such that its optical beam is flush with the central part of the handle n+i if a handle awaiting application has a length equal to the nominal length, and such that its optical beam is cut by the central part of the handle n+i if a handle awaiting application has a length greater than the nominal length and thus causes the tape to advance by an insufficient length.

According to a preferred embodiment of the invention, the ends of the rotary arm are each equipped with an actuator supporting a roller, over which the tape can be wound, each actuator being able to occupy a retracted position in which the length of the arm is equal to the nominal length and a deployed position in which the length of the arm is then greater than the nominal length.

According to one possible configuration, the means for feeding the tape comprise a mandrel on which a reel of tape can be engaged and a series of pulleys guiding the tape as far as the rotary arm.

Advantageously, the feed means comprise, furthermore:

a drive drum situated between the mandrel and the rotary arm. The presence of this drum ensures that the tensile force of the tape is taken up, an oscillating pulley block positioned between the drive drum and the rotary arm, an oscillating pulley block positioned between the mandrel and the drive drum.

The presence of these two oscillating pulley blocks makes it possible to maintain a constant tension in the tape and to distribute the tension between the various pulleys of a pulley block.

The invention also aims to provide a method of applying to a pack, moved along a conveyor, a handle n of nominal length L situated at the end of a tape comprising a succession of handles n+i, each comprising two adhesive ends and a central part, comprising the steps consisting in:

feeding the tape as far as a rotary application arm having a length which is equal to the nominal length, initiating the rotation of the arm so that a first adhesive end of the handle n is deposited on a front face of the pack and the second adhesive end is deposited on a rear face of the pack during the advancing movement of the pack, detecting an offset in the position of a handle n+i, situated upstream of the handle n, with respect to the theoretical position of the handle n+i corresponding to a multiple of the nominal length L, bringing about an elongation of the length of the arm beyond the nominal length if an offset is detected, rotating the arm so as to draw a length of tape exceeding the nominal length of a handle, returning the length of the arm to a length corresponding to the nominal length L.

In order to provide a clear understanding of the invention, it will be described with reference to the appended drawing representing, by way of non-limiting example, an embodiment of a device according to the invention.

DETAILED DESCRIPTION OF EMBODIMENTS

Figure 1:
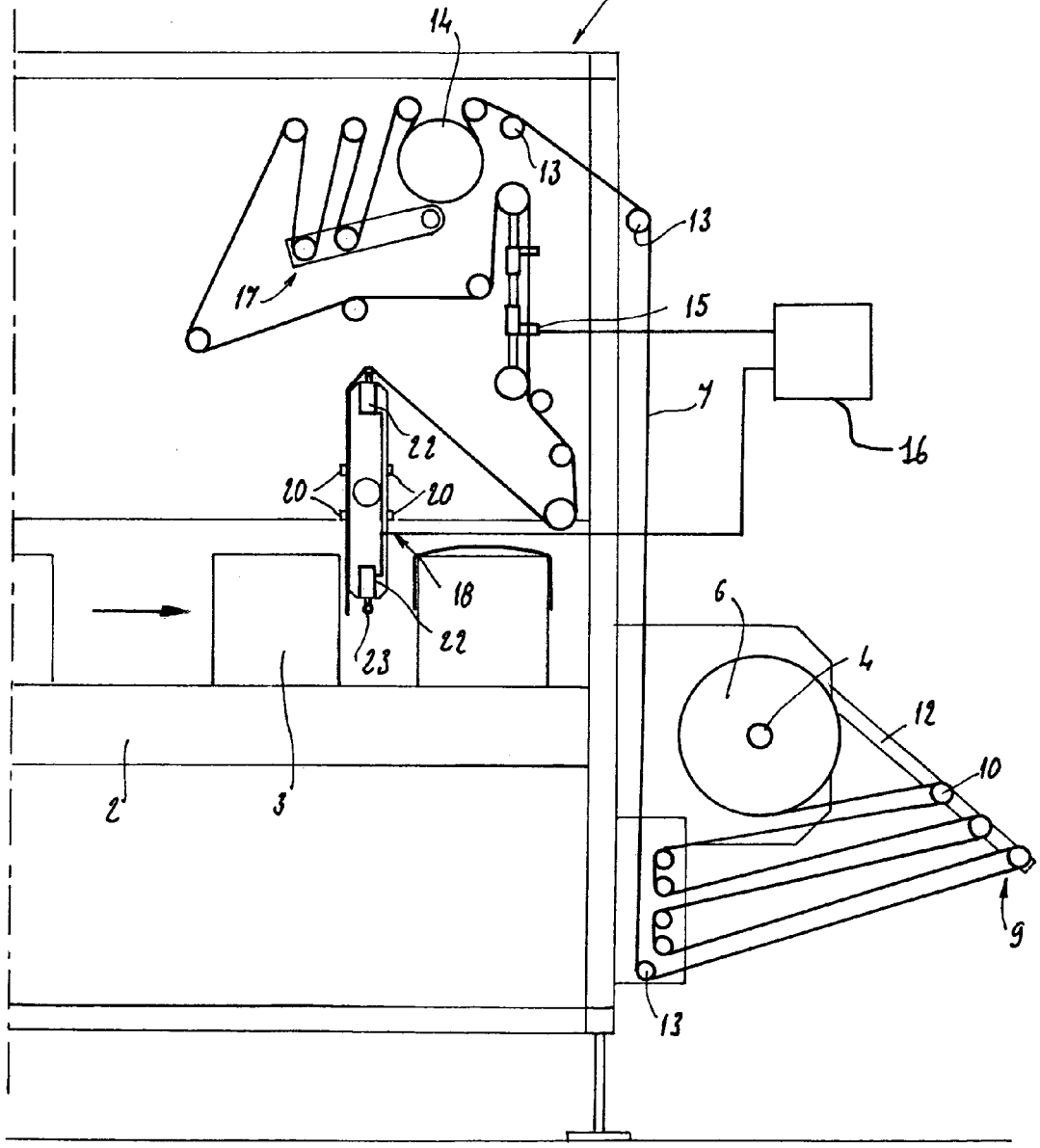
FIG. 1 is an overall schematic view of this device.

The handle application device according to the invention as it appears in FIG. 1 comprises a number of subassemblies, other than a belt conveyor 2 over which packs 3 travel continuously.

The device comprises a frame 5 which supports members for receiving a reel 6 of the adhesive tape 7 and members for guiding the tape 7 until it is applied to a pack 3.

Throughout the description which will follow, reference will be made to a tape 7 incorporating so-called prepared handles, that is to say a tape 7 incorporating labels 8 which are uniformly distributed with a defined pitch.

Without entering into the precise structural details of the device, and describing this device with respect to the direction in which the tape 7 is unwound, it will be noted first of all that there a mandrel 4 is present on which a reel 6 of adhesive tape 7 is engaged.

The tape 7 then passes through an oscillating pulley block 9, that is to say a succession of rollers 10 mounted on an oscillating lever 12, the purpose of which is to maintain a constant tension in the adhesive tape 7.

Passing via a series of return pulleys 13, the tape 7 is wound around a motorized drive drum 14.

The tape 7 then passes through a second oscillating pulley block 17 for maintaining the tension of the adhesive tape 7.

On leaving the pulley block 17, the adhesive tape 7 is guided as far as a rotary arm 18.

An important point of the device is that the tape 7 passes through an optical detection cell 15.

The rotary arm 18, which rotates in the anticlockwise direction in the example represented in FIG. 1, receives the adhesive tape 7; a retractable clamp 20 is arranged on each face of the arm 18 so as to retain the strip 7 when it is in place on one or other of the faces of the arm 18. Although not represented in FIG. 1, a cutter system makes it possible to section a handle from the strip 7 during the rotation of the arm 18. For more details concerning the operation of the clamps 20 and the system for sectioning the tape 7, a person skilled in the arm may usefully refer to the document FR 2 787 416.

As can be seen in this figure, the arm 18 rotates in opposition to the direction of movement of the conveyor 2. In the standby position, the arm 18 is oriented in the vertical direction, and is therefore perpendicular to the plane of the conveyor 2. The tape 7 extends over the whole face of the arm 18 facing a pack 3 which is present. That face of the tape 7 coated with adhesive is directed towards the outside of the arm 18.

When a pack 3 driven by the conveyor 2 advances, it comes into contact with the arm 18. The tape 7 is then stuck onto the front face of the pack 3 in contact with the arm 18. A sensor (not shown in the drawing) detects the presence of the pack 3 and causes the arm 18 to rotate through an angle of 180°.

The rotational movement is synchronized with the movement of the pack 3 such that, at the end of rotation, the tape 7 is stuck onto the rear face of the pack 3 (the terms front and rear are given with reference to the direction of movement of the conveyor 2). Synchronizing the speed of rotation of the arm 18 and the speed of the conveyor 2 is achieved by means of speed regulators.

It should be noted that, when the tape 7 is being applied to a pack 3 to form a handle, a portion of tape 7 is automatically drawn onto the arm 18 so as to form, in preparation of the application, a new handle.

Figure 2:
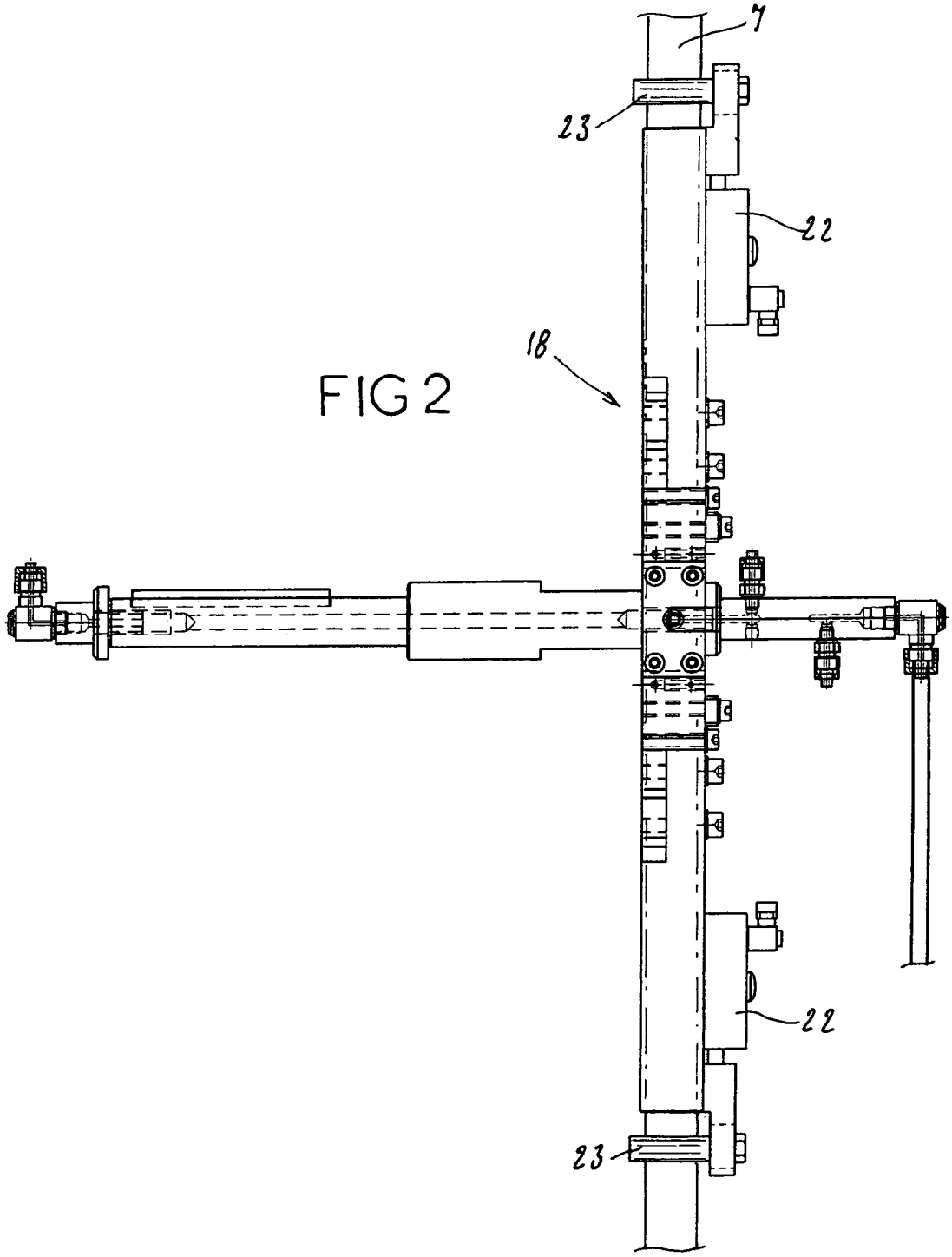
FIG. 2 is a view of a rotary arm.

With reference to FIG. 2, it can be seen that the ends of the arm 18 are each equipped with an actuator 22 which supports a roller 23 over which the adhesive tape 7 is wound. Each of the actuators 22 is controlled independently of one another.

The arm 18 has a length which is equal to the nominal length of the handle. As has been explained in the preamble of the present document, the actual length of a handle varies randomly but within a given range, however.

The operation of the arm 18 in relation to the optical cell 15 is schematically illustrated in FIGS. 3, 4, 5, 6 according to various scenarios.

These figures represent the tape 7 in a position in which it is waiting to be applied and two handles n+1, n+2 upstream; each of the handles has an opaque label 8.

Figure 3:
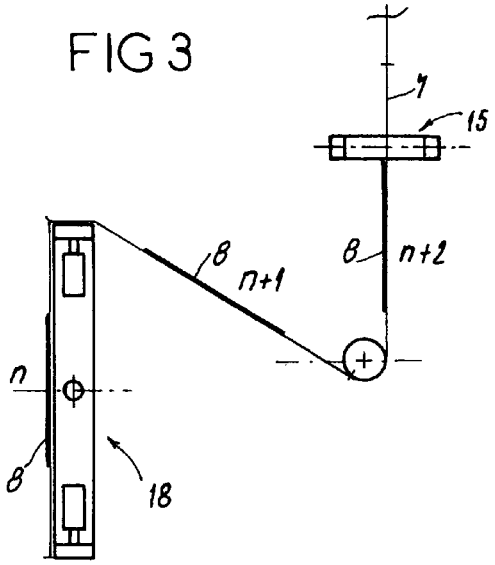
FIGS. 3 to 6 schematically show the operation of the device during successive applications of a number of so-called prepared handles.
Figure 4:
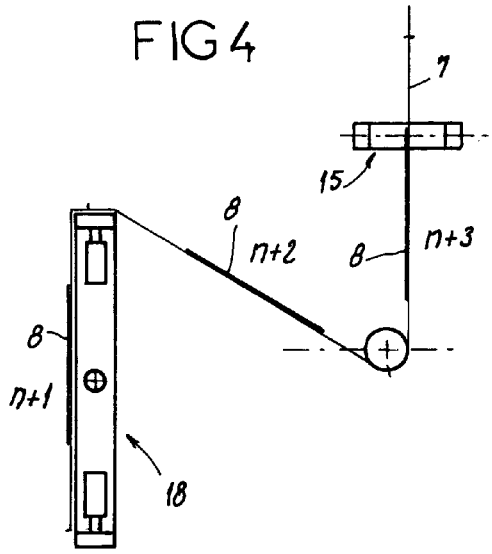
Figure 5:
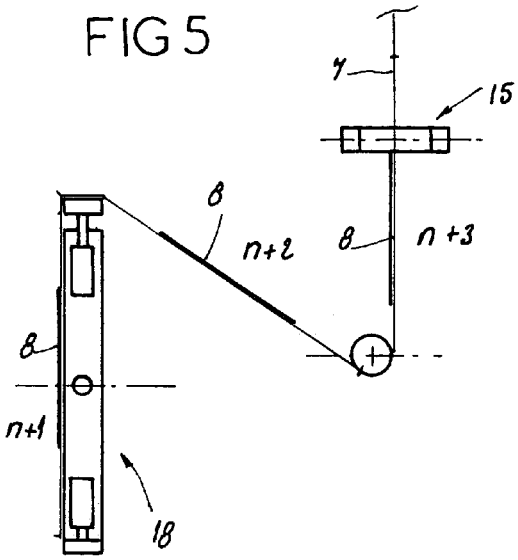
Figure 6:
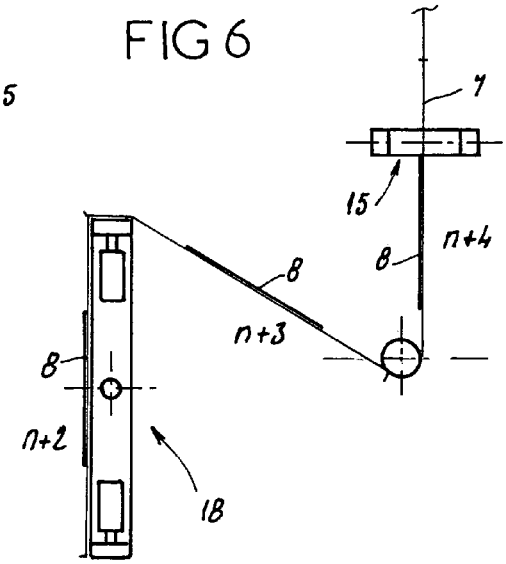

In FIG. 3, the arm 18 has a dimension corresponding to the nominal dimension of the handle.

When the label is applied during the rotation of the arm 18, the label n+1 is drawn into a standby position on the arm 18. On account of the elongation of the tape 7, the tape 7 may find itself in the scenario represented in FIG. 4.

In the case of the handle n+1 being elongated, this handle is longer than the nominal length. Consequently, the label is longer than the arm 18, which means that the tape 7 has not been drawn by a length equal to the nominal length of a label 8. In actual fact, the tape 7 has been drawn by a length which is slightly less than the nominal length of a handle.

The cell 15, which is positioned upstream of the arm 18 at a distance corresponding to three times the nominal length of a handle less the length of the adhesive end, detects an offset in the handle n+3. Specifically, the offset is detected by virtue of the fact that the label of the handle n+3 cuts the optical beam of the cell. Thus, the cell 15 identifies the offset in the handle n+1 and in all the handles preceding it.

The cell 15 is connected to an electronic control unit 16, which may be a microprocessor, to which the cell 15 sends a signal should an offset be detected between the theoretical and actual position of the handle n+3.

The control unit 10 may of course control other functions of the device.

If an offset is detected, a signal is sent by the control unit 16 to the actuator 22 of which the roller supports the tape 7; this is the actuator 22 situated on the upper side of the rotary arm 18.

The consequence of the actuator 22 being deployed is to increase the length of the arm 18.

The handle n+1 is applied to the pack 3 by the rotation of the arm 18. Now, this rotational movement is performed using an arm 18 having a length greater than the nominal length of a handle. This makes it possible to correct the positional error immediately since the tape 7 is drawn by a length greater than the nominal length.

Upon the subsequent rotation, the actuator 22 which was deployed is retracted, returning the arm 18 to a length equal to the nominal length.

The actuators 22 are not actuated systematically on each rotation but only when an elongation of the handle awaiting application on the arm 18 is identified.

It should be pointed out that the device operates optimally by virtue of three other arrangements of the invention.

The presence of the pulley block 9 situated directly downstream of the reel 6 and upstream of the motorized drum 14 will be noted first of all. This pulley block 9 maintains a constant tension in the tape 7 during the unwinding thereof.

Next, an important arrangement of the device is the presence of a motorized drum 14 along the path of the tape 7. This drum 14 ensures that the tensile force of the tape 7 is taken up. Now, it should be kept in mind that a reel 6 for so-called prepared handles has a mass of around 22 kg for a length of 7000 m. Such a reel 6 therefore has very considerable inertia which the rotation of the arm 18 alone may have difficulties in overcoming. In operation, when the rotation of the arm 18 is initiated, the drum 14 starts to rotate.

Furthermore, an oscillating pulley block 17 is interposed between the drum 14 and the arm 18 and it permanently maintains a constant tension in the tape 7.

The device thus described has the numerous advantages indicated above and makes it possible in particular to deposit so-called prepared handles by means of a device with a rotary arm 18.

Of course, the invention is not limited to the embodiment described above by way of example but, on the contrary, it encompasses all the embodiments thereof. Thus, while in the example described the tape 7 has handles whose central part consists of a cardboard label, it would be possible to envisage using the device according to the invention for handles whose central part is simply formed by a printed region. An optical detection system is provided for detecting the offset in a handle upstream of the handle being applied, but it would be possible to envisage a sensor detecting the excess thickness of a label 8 when it is not at its normal position.

The invention claimed is:

1. Device making it possible to apply to a pack, moved along a conveyor, a handle n of nominal length L situated at the end of a tape comprising a succession of handles n+i, each handle comprising two adhesive ends and a central part, the device comprising means for feeding the tape as far as a rotary application arm having a length which is equal to the nominal length L, this arm being able to deposit one adhesive end of the handle n on one face of the pack and then the second end of the handle n on a second face of the pack during a 180° rotation of the arm which is synchronous with the advancing movement of the pack on the conveyor, characterized in that the device comprises:

means for detecting an offset in the position of a handle n+i, which is awaiting application and is situated upstream of a handle n, with respect to the theoretical position of the handle n+i corresponding to a multiple of the nominal length, this offset being due to an elongation of the handle n beyond the nominal length of a handle, and means for elongating the length of the rotary arm beyond the nominal length L, making it possible during a rotation of this arm to draw a portion of tape having a length greater than the nominal length, a control unit which is connected, on the one hand, to the detection means and can receive a signal therefrom if an offset in the position of a handle n+i with respect to the theoretical position of the handle n+i is detected and which is connected, on the other hand, to the elongation means so as to control the elongation thereof if an offset is detected.

2. Device according to claim 1, characterized in that the device further comprises a means for the optical detection of an offset in the position of a handle n+i.

3. Device according to claim 2, characterized in that the ends of the rotary arm are each equipped with an actuator supporting a roller, over which the tape can be wound, each actuator being able to occupy a retracted position in which the length of the arm is equal to the nominal length and a deployed position in which the length of the arm is then greater than the nominal length.

4. Device according to claim 3, characterized in that the means for feeding the tape comprise a mandrel on which a reel of tape can be engaged and a series of pulleys guiding the tape as far as the rotary arm.

5. Device according to claim 2, characterized in that the means for feeding the tape comprise a mandrel on which a reel of tape can be engaged and a series of pulleys guiding the tape as far as the rotary arm.

6. Device according to claim 1, characterized in that an optical detection cell is placed along the path over which the tape unwinds at a distance from the rotary arm which is equal to a multiple of the nominal length of a handle less the length of one adhesive end.

7. Device according to claim 6, characterized in that the ends of the rotary arm are each equipped with an actuator supporting a roller, over which the tape can be wound, each actuator being able to occupy a retracted position in which the length of the arm is equal to the nominal length and a deployed position in which the length of the arm is then greater than the nominal length.

8. Device according to claim 6, characterized in that the means for feeding the tape comprise a mandrel on which a reel of tape can be engaged and a series of pulleys guiding the tape as far as the rotary arm.

9. Device according to claim 1, characterized in that the means for feeding the tape comprise a mandrel on which a reel of tape can be engaged and a series of pulleys guiding the tape as far as the rotary arm.

10. Device according to claim 9, characterized in that the feed means comprise, furthermore, a drive drum situated between the mandrel and the rotary arm.

11. Device according to claim 10, characterized in that the feed means comprise, furthermore, an oscillating pulley block positioned between the drive drum and the rotary arm.

12. Device according to claim 11, characterized in that the feed means comprise, furthermore, an oscillating pulley block positioned between the mandrel and the drive drum.

13. Device according to claim 10, characterized in that the feed means comprise, furthermore, an oscillating pulley block positioned between the mandrel and the drive drum.

14. Device according to claim 9, characterized in that the feed means comprise, furthermore, an oscillating pulley block positioned between the mandrel and the drive drum.

15. Method of applying to a pack, moved along a conveyor, a handle n of nominal length L situated at the end of a tape comprising a succession of handles n+i, each comprising two adhesive ends and a central part, the method comprising the steps of:

feeding the tape as far as a rotary application arm having a length which is equal to the nominal length, initiating the rotation of the arm so that a first adhesive end of the handle n is deposited on a front face of the pack and the second adhesive end is deposited on a rear face of the pack during the advancing movement of the pack, detecting an offset in the position of a handle n+i, situated upstream of the handle n, with respect to the theoretical position of the handle n+i corresponding to a multiple of the nominal length L, bringing about an elongation of the length of the arm beyond the nominal length if an offset is detected, rotating the arm so as to draw a length of tape exceeding the nominal length of a handle, returning the length of the arm to a length corresponding to the nominal length L.

* * * * *